US007234745B1

(12) United States Patent
Tsai

(10) Patent No.: US 7,234,745 B1
(45) Date of Patent: Jun. 26, 2007

(54) CHOPSTICKS

(76) Inventor: Sen-Jun Tsai, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 11/368,516

(22) Filed: Mar. 7, 2006

(51) Int. Cl.
*A47G 21/10* (2006.01)

(52) U.S. Cl. ..... 294/99.2; 294/1.1

(58) Field of Classification Search ..... 294/99.2, 294/116, 8.5, 11; 24/495, 496, 506, 511, 24/517

See application file for complete search history.

(56) References Cited

U.S. PATENT DOCUMENTS

| | | | | | |
|---|---|---|---|---|---|
| 448,155 | A * | 3/1891 | Merril | 294/99.2 |
| 530,455 | A * | 12/1894 | Raymond | 294/11 |
| 554,003 | A * | 2/1896 | Peterson | 294/8.5 |
| 2,483,303 | A * | 9/1949 | Rysick | 24/496 |
| 2,711,339 | A * | 6/1955 | McGogy | 294/99.2 |
| 3,884,456 | A * | 5/1975 | Lew | 294/99.2 |
| D283,192 | S * | 4/1986 | Kono | D7/642 |
| 7,017,964 | B2 * | 3/2006 | Hao | 294/99.2 |
| 7,052,061 | B2 * | 5/2006 | Calagui | 294/99.2 |

FOREIGN PATENT DOCUMENTS

| | | | | |
|---|---|---|---|---|
| FR | 002641592 | * | 7/1990 | 294/99.2 |
| GB | 2202426 | * | 9/1988 | |
| JP | 2002017545 | * | 1/2002 | |

* cited by examiner

*Primary Examiner*—Patrick Mackey
*Assistant Examiner*—Paul T. Chin

(57) ABSTRACT

A pair of chopsticks includes two elongate bodies facing each other, and a connector pivotally connected with and between the two elongate bodies. The elongate bodies respectively have a hollow near an upper end. The connector has a plate spring, which has one end pivotally connected to the hollow of each elongate body. Thus the connector connects the two elongate bodies together so that the lower end sections of the two elongate bodies may be closed by pushing the two bodies inward to each other for picking up food, and opened by letting loose a hand clamping the two bodies for next round of picking up food.

2 Claims, 5 Drawing Sheets

CHOPSTICKS

BACKGROUND OF THE INVENTION

1. Field of the Invention

This invention relates to a pair of chopsticks, particularly to one automatically expanded out after clamped together for use with convenience.

2. Description of the Prior Art

A pair of chopsticks is an indispensable tool used for picking up food in a meal in the Orient, generally composed of two elongate sticks of the same size and shape, and users have to be dexterous to expand or shrink together the two sticks for picking up food, so those such as the old or the small or some handicapped people or foreigners rarely using them may not be good at using chopsticks in taking a meal. So food may easily be dropped off chopsticks, impossible to be picked up smoothly for users to feel very embarrassed.

SUMMARY OF THE INVENTION

The purpose of the invention is to offer a pair of chopsticks easily and automatically expanded out every time when they are clamped together for picking up food.

The feature of the invention is a connector pivotally connected with two chopsticks and having a plate spring that has its outer end fixed in a hollow formed in each chopstick so that the pair of chopsticks may be easily and automatically expanded out from each other every time when they are clamped together for picking up food.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
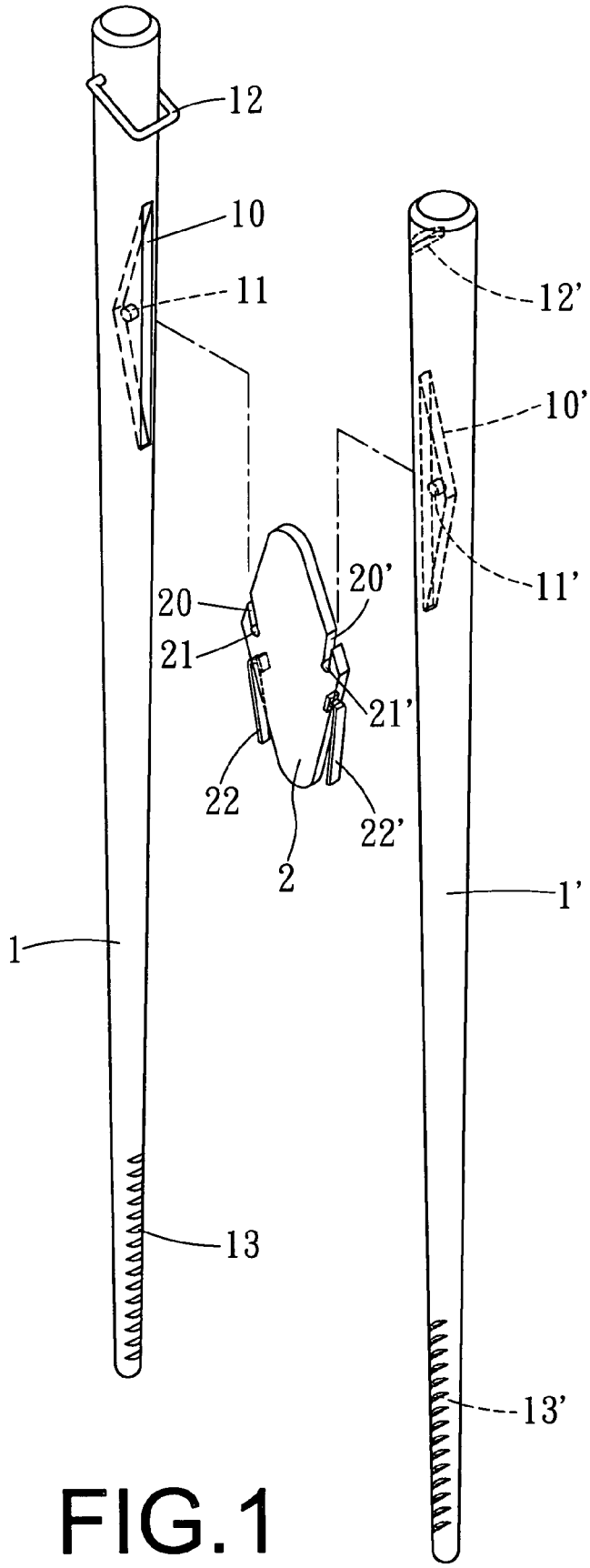
FIG. 1 is an exploded perspective view of a pair of chopsticks in the present invention.

A preferred embodiment of a pair of chopsticks in the present invention, as shown in FIG. 1, includes two elongate bodies 1, and 1', and a connector 1 as main components.

Each elongate body 1, 1' is formed with a hollow 10, 10' near an upper end, a pivot 11, 11' fixed in the hollow, and a ring 12 fixed to one of the two elongated bodies 10, 10', a fitting hole 12' formed in the other one of the two elongated bodies 10, 10' for receiving the ring 12. Further, each body 10, 10' has a frictional surface 13, 13' formed in a lower end section.

The connector 2 can be pivotally connected to the pivots 11, 11' and is capable of being located movably between the two elongate bodies 10, 10'. Upper sides of the connectors 2 have respective slots 20, 20'. Each slot 20, 20' has an engage hole 21, 21' formed in the inner end of each slot 20, 20', and each of two lower sides of the connector 2 has a plate spring 22, 22'.

Figure 2:
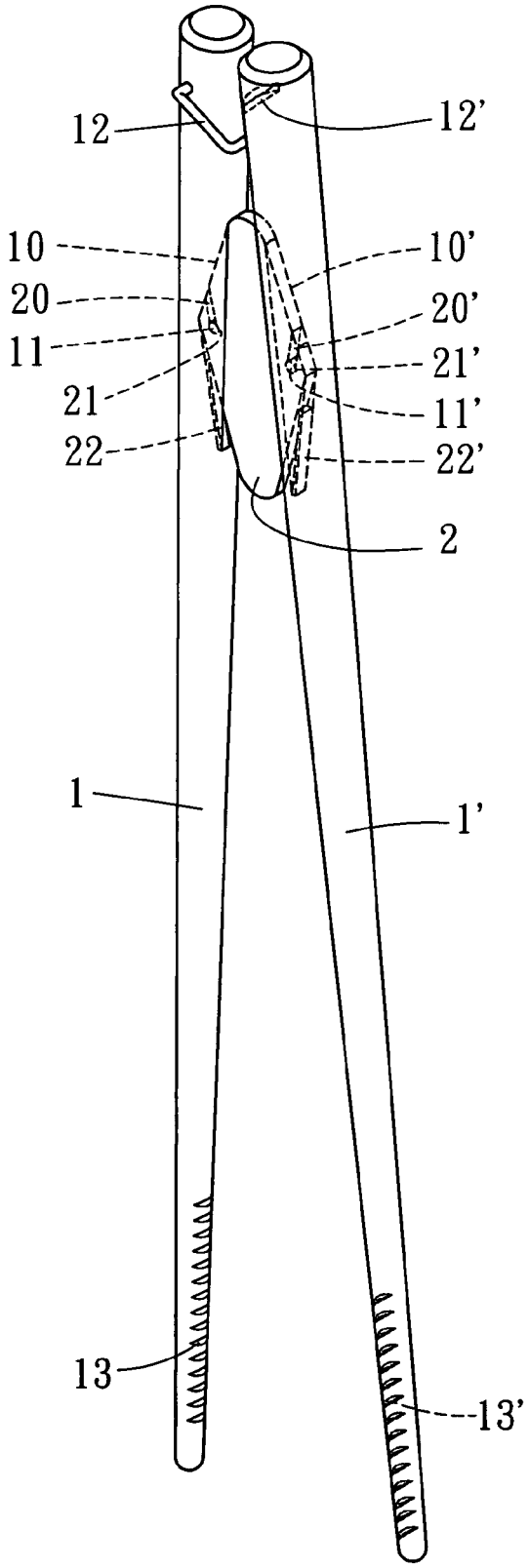
FIG. 2 is a perspective view of the pair of chopsticks in the present invention.

In assembling, as shown in FIGS. 1 and 2, the two sides of the connector 2 are inserted in the two hollows 10, 10', with the pivots 11, 11' respectively engaging stably in the engage holes 21, 21' after sliding through the slots 20, 20'. So the two elongate bodies 1, 1' are pivotally connected with the connector 2, with the two plate springs 22, 22' of the connector 2 contacting elastically the inner wall of the hollow 10. 10' in a closed condition of the lower end section of the pair of chopsticks. Then the plate spring 22, 22' can expand out the lower end of the chopsticks elastically if the hand loosens the closed condition of the chopsticks. Thus the pair of chopsticks is finished in assemblage.

Figure 3:
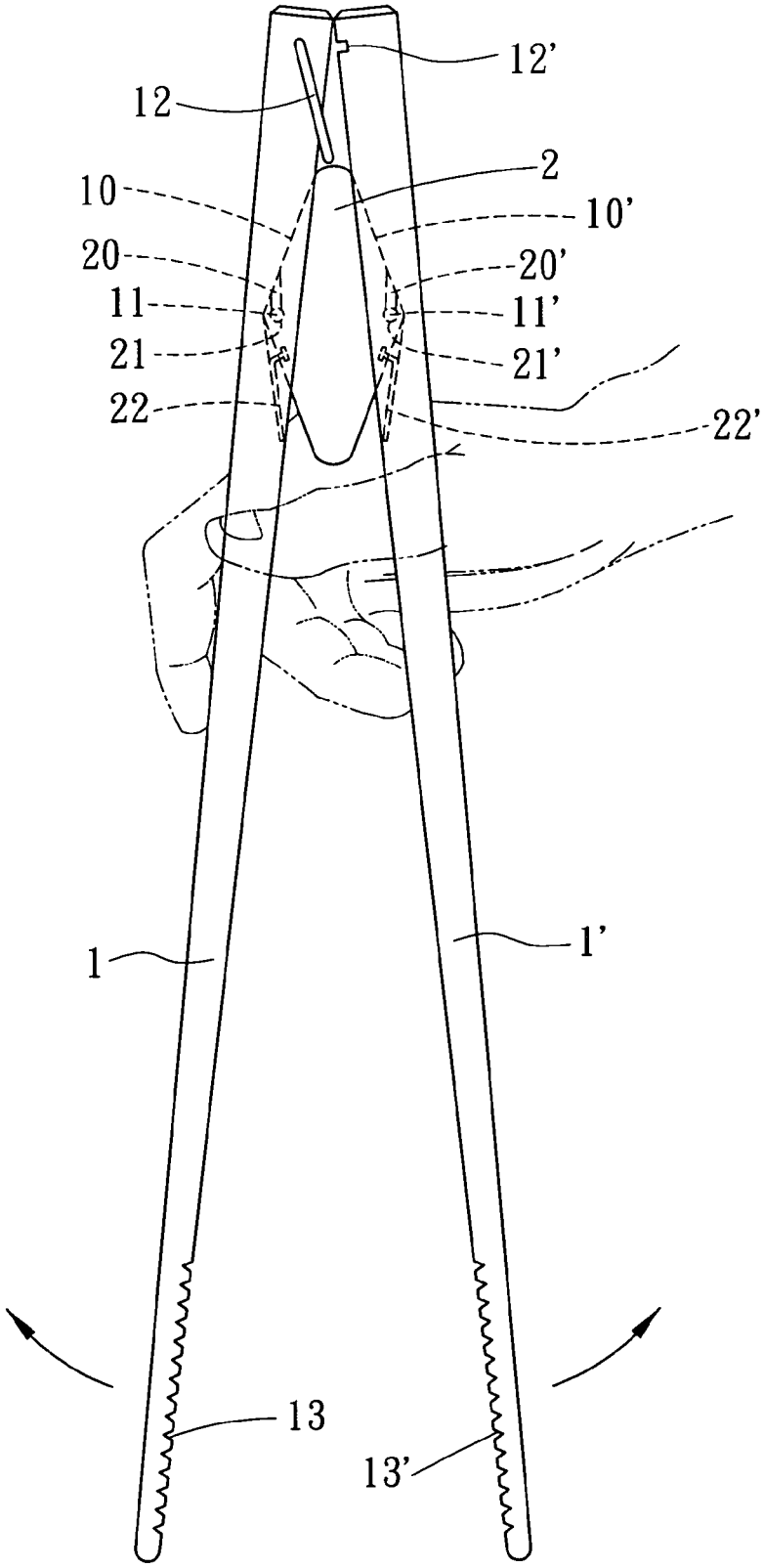
FIG. 3 is a persecutive view of the pair of chopsticks expanded out in the present invention.
Figure 4:
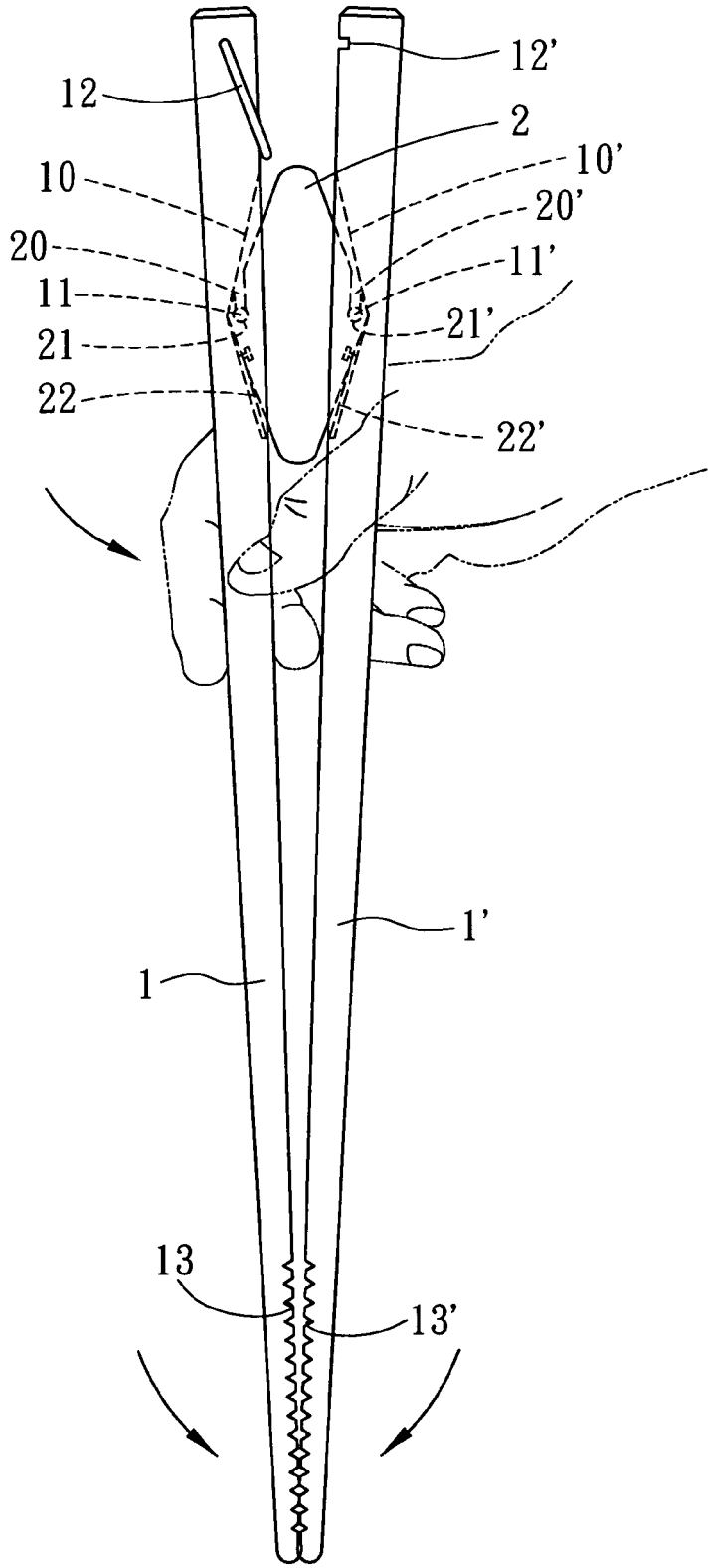
FIG. 4 is a perspective view of the pair of chopsticks with the lower end clamped together by a hand in the present invention.
Figure 5:
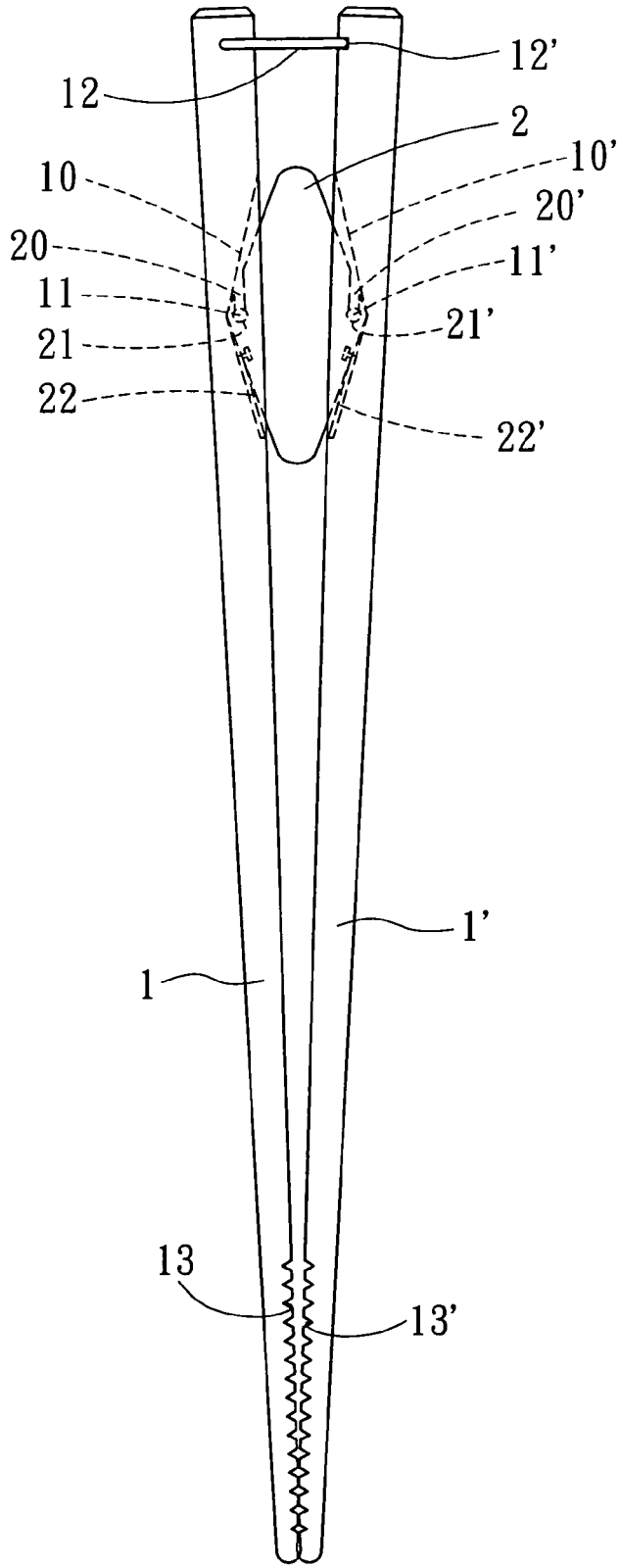
FIG. 5 is a side view of the pair of chopsticks maintained in the closed condition with a ring in the present invention.

In using, as shown in FIGS. 3, 4 and 5, when a hand does not push or clamp the two elongate bodies 1, 1' inward to each other, the two elongate bodies 1, 1' may have their lower end section expanded outward by the elasticity of the plate springs 22, 22' as shown in FIG. 3. Then a user exerts force on the hand holding the two elongate bodies 1, 1', letting the lower end section of the two elongate bodies 1, 1' move inward to each other as shown in FIG. 4. Then the lower end sections of the two elongate bodies 1, 1' can be closed to pick up food therebetween, with the plate springs 22, 22' being in a compressed condition. If the hand is let loose against the two elongate bodies 1, 1', the lower end sections of the bodies 1, 1' may be expanded out again, ready for next round of picking food. Further the lower end sections of the elongate bodies 1, 1' are provided with a frictional surface 13, 13' facing each other, they can pick up food easily by means of the frictional surfaces 13, 13' contacting food, preventing food sandwiched from falling down. In addition, as there are the plate springs 22, 22' fixed with the connector 2, a user does not need to force his hand for expanding out the two elongate bodies to let food sandwiched released, but only letting loose his hand can attain the object. Therefore, it is natural that a user may hold the two elongate bodies 1, 1' on the portions where the connector 2 is located, so that the plate springs 22, 22' can be compressed for picking up food. Thus a user can easily hold the chopsticks in the invention in a correct position for using.

Next, provided that the chopsticks is not to be used and stored away, as shown in FIG. 5, a user expands the upper end of one elongate bodies 1' a little, and lifts the ring 12 and fits its outer end in the fitting groove 12' of the body 1', with the plate springs 22, 22' kept compressed, and with the lower end sections of the two elongate bodies 1, 1' kept closed. Then the pair of chopsticks is convenient for storing away, needing only a small space. For next round of use, only separate the ring 12 from the body 1' as shown in FIG. 3, then the lower end sections of the two elongate bodies 1, 1' are expanded out, ready for use.

As can be seen from the foresaid description, the invention has the following advantages.

1. It is convenient to use for beginners, with its correct position for holding being naturally understood.
2. The lower end sections of two elongate bodies are automatically expanded out after closed for picking up food, if a hand holding them is let loose.
3. The two elongate bodies can be kept the lower end sections closed for storing away in a small space.

While the preferred embodiment of the invention has been described above, it will be recognized and understood that various modifications may be made therein and the appended claims are intended to cover all such modifications that may fall within the spirit and scope of the invention.

What is claimed is:

1. A pair of chopsticks comprising two elongate bodies, each of said two elongate bodies being respectively provided with a hollow recess near an upper end thereof, a connector capable of being pivotally connected between said two hollow recesses of the two elongate bodies, said connector having an approximate rhombus shape; each of two lower sides of said connector having a respective plate spring, wherein each of an inner side of said plate spring is capable of contacting elastically a wall of a respective one of said hollow recesses; and wherein one of the two elongated bodies has a ring at an upper end thereof which is inserted in an upper end of the respective elongated body; and the other one of said two elongate bodies is provided with a fitting groove near an upper end thereof for receiving an outer end of said ring; and wherein each of said hollow is provided with a pivot, and each of two upper sides of said connector is provided with a slot for receiving a respective one of two pivots.

2. The pair of chopsticks as claimed in claim 1, wherein said two elongate bodies are provided with a frictional surface formed in a lower end section.

* * * * *